US007397173B2

(12) United States Patent
Min

(10) Patent No.: US 7,397,173 B2
(45) Date of Patent: Jul. 8, 2008

(54) LIGHTING APPARATUS USING MICROWAVE ENERGY

(75) Inventor: Byoung-Ok Min, Seoul (KR)

(73) Assignee: LG Electronics Inc. (KR)

( * ) Notice: Subject to any disclaimer, the term of this patent is extended or adjusted under 35 U.S.C. 154(b) by 40 days.

(21) Appl. No.: 10/769,159

(22) Filed: Jan. 29, 2004

(65) Prior Publication Data

US 2005/0001525 A1 Jan. 6, 2005

(30) Foreign Application Priority Data

Jul. 2, 2003 (KR) ..... 10-2003-0044659

(51) Int. Cl.
*H01J 5/16* (2006.01)
*H01J 65/04* (2006.01)
*H05B 41/16* (2006.01)

(52) U.S. Cl. ..... 313/153; 313/113; 315/248; 315/39; 315/344

(58) Field of Classification Search ..... 313/113, 313/114, 153, 234; 362/506, 296, 346, 347, 362/516, 514; 348/786; 359/614; 315/248, 315/111.81, 344, 39
See application file for complete search history.

(56) References Cited

U.S. PATENT DOCUMENTS 4,658,179 A * 4/1987 Roberts ..... 313/113
5,334,913 A * 8/1994 Ury et al. ..... 315/248
5,621,267 A 4/1997 Shaffner et al.
2003/0057841 A1 3/2003 Kang

FOREIGN PATENT DOCUMENTS

| | | | |
|---|---|---|---|
| EP | 1124089 A2 | * | 8/2001 |
| JP | 2000-353495 | | 12/2000 |
| JP | 2001-283780 | | 10/2001 |
| JP | 2001-302338 | | 10/2001 |
| JP | 2001-338620 | | 12/2001 |
| KR | 2002-0054161 | | 7/2002 |
| WO | WO 97/27617 | * | 7/1997 |
| WO | WO 98/53475 | * | 11/1998 |

OTHER PUBLICATIONS

Untranslated Office Action issued by Japanese Patent Office on Oct. 18, 2005.
Search Report issued on Aug. 30, 2005 by European Patent Office in connection with corresponding application No. EP 04 29 0009.2.

* cited by examiner

*Primary Examiner*—Karabi Guharay
(74) *Attorney, Agent, or Firm*—Ostrolenk, Faber, Gerb & Soffen, LLP

(57) ABSTRACT

A lighting apparatus using microwave energy comprises, a magnetron disposed inside a casing, for generating microwave energy; a waveguide for guiding microwave energy; a resonator providing a resonant region in which the microwave energy is resonated; a bulb disposed inside the resonator, and filled with a material which emits light, when excited by the microwave energy; and a rear mirror integrally fixed to a rear of the bulb, for forwardly reflecting light which is rearward emitted from the bulb.

4 Claims, 3 Drawing Sheets

LIGHTING APPARATUS USING MICROWAVE ENERGY

BACKGROUND OF THE INVENTION

1. Field of the Invention

The present invention relates to lighting apparatus using microwave energy, and particularly, to a lighting apparatus using microwave energy capable of improving lighting efficiency.

2. Description of the Background Art

In general, lighting apparatus using microwave energy is a lighting system in which microwave energy generated from a magnetron is transmitted to a resonator through a waveguide, and a fill within a bulb disposed in the resonator emits visible light when excited by the microwave energy. The lighting apparatus using microwave energy has longer life span compared to an incandescent lamp or a fluorescent lamp and has excellent efficiency in lighting.

As shown in FIG. 1, a lighting apparatus using microwave energy comprises a casing 10 having an opening 12 through which microwave energy passes at its one side and a flange 14 outwardly extended from a circumference of the opening 12; a high voltage generator 20 installed inside the casing 10, and for generating and supplying high voltage; a magnetron 30 disposed inside the casing 10, electrically connected with the high voltage generator 20 to generate microwave energy by high voltage; a waveguide 40 fixed to a front surface of the casing 10, and for guiding microwave energy generated from the magnetron 30 toward the opening 12 of the casing 10; a resonator 50 fixed to the flange 14 of the casing 10, communicated with the waveguide 40, and having a resonant region therein where microwave energy is resonated; a bulb 60 rotatably mounted inside the resonator 50, and containing a fill which emits light when excited by microwave energy; a reflector 80 fixed to an outer surface of the casing 10, for forwardly reflecting light emitted from the bulb 60; a fan housing 110 installed inside the casing 10, having an airflow path therein through which an external air is sucked, for cooling heat generated from the high voltage generator 20 and the magnetron 30; a cooling fan 100 provided within the fan housing 110, for sucking external air; a fan motor 101 for rotating the cooling fan 100; a bulb motor 90 for rotating the bulb 60, of which a rotational shaft 92 is connected to a bulb stem 62 extended from the bulb 60; and a disk shaped rear mirror 70 fixed to the flange 14, having a hole 72 at a center thereof in which the bulb stem 62 is inserted.

In the light apparatus according to the conventional art as above, high voltage is generated at the high voltage generator 20 when an external power is applied to the high voltage generator 20, and microwave energy is generated at the magnetron 30 by the high voltage. And, the microwave energy is transmitted to the resonator 50 through the waveguide 40, and excites the fill within the bulb 60. Accordingly, the fill within the bulb 60 emits light, and the reflector 80 reflects the light emitted around the bulb 60. Also, the rear mirror 70 forwardly reflects the light emitted rearwardly from the bulb 60.

At the same time, the cooling fan 100 is rotated by an operation of the fan motor 101, and thus external air out of the casing 10 is sucked into the casing 10 through the airflow path formed inside the fan housing 110. By the airflow inside the casing 10, the high voltage generator, the magnetron 30 and the other internal components are cooled. In addition, the bulb 60 is rotated for being cooled by an operation of the bulb motor 90.

In the lighting apparatus using microwave energy according to the conventional art as above, one of important factors that have an effect on lighting performance is an effective reflection of light emitted from the bulb 60. Accordingly, the reflector 80 is installed around the bulb 60, and the rear mirror 70 is installed at a rear side of the bulb 60, so that the reflector 80 and the rear mirror 70 forwardly reflect light that is emitted around the bulb and to a rear side of the bulb.

However, since the rear mirror 70 provided for the lighting apparatus according to the conventional art is formed in a flat disk shape, the rear mirror 70 cannot effectively reflect light emitted toward the rear of the bulb 60.

Moreover, since the hole 72 is formed in the center of the rear mirror 70 so that the bulb stem 62 is rotatably inserted thereto, even if the hole 72 is formed to have a minimum diameter in which the bulb stem 62 can be rotated in order to reflect the light emitted to the rear of the bulb 60 as much as possible, the light emitted from the bulb 60 is not fully reflected because of the hole 72. Further, the light which is not reflected because of the hole 72 may pass through the hole 72 and may be transmitted to a rear of the mirror 70, or may be scattered by the hole 72, thereby causing degradation in light reflection efficiency In addition, heat generated from the bulb 60 is transmitted to the bulb stem 62, and thus a thermal damage such that a coated layer is peeled away at a portion adjacent to the bulb stem 62 may be generated. Therefore, components have to be replaced because of such a thermal damage of the rear mirror 70, thereby raising high material and operation costs. In order to prevent the thermal damage, the rear mirror 70 is made of a high priced heat resistible material such as quartz, thereby raising an initial installation cost.

SUMMARY OF THE INVENTION

Therefore, an object of the present invention is to provide a lighting apparatus using microwave energy capable of improving reflection efficiency of light rearwardly emitted from the bulb, and also reducing material cost of the mirror.

To achieve these and other advantages and in accordance with the purpose of the present invention, as embodied and broadly described herein, there is provided a lighting apparatus using microwave energy, comprising a magnetron disposed inside a casing, for generating microwave energy; a waveguide for guiding microwave energy; a resonator providing a resonant region in which the microwave energy is resonated; a bulb disposed inside the resonator, and filled with a material which emits light, when excited by the microwave energy; and a rear mirror integrally fixed to a rear of the bulb, for forwardly reflecting light rearwardly emitted from the bulb.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a light apparatus using microwave energy according to one embodiment of the present invention will now be described with reference to FIG. 2.

Figure 1:
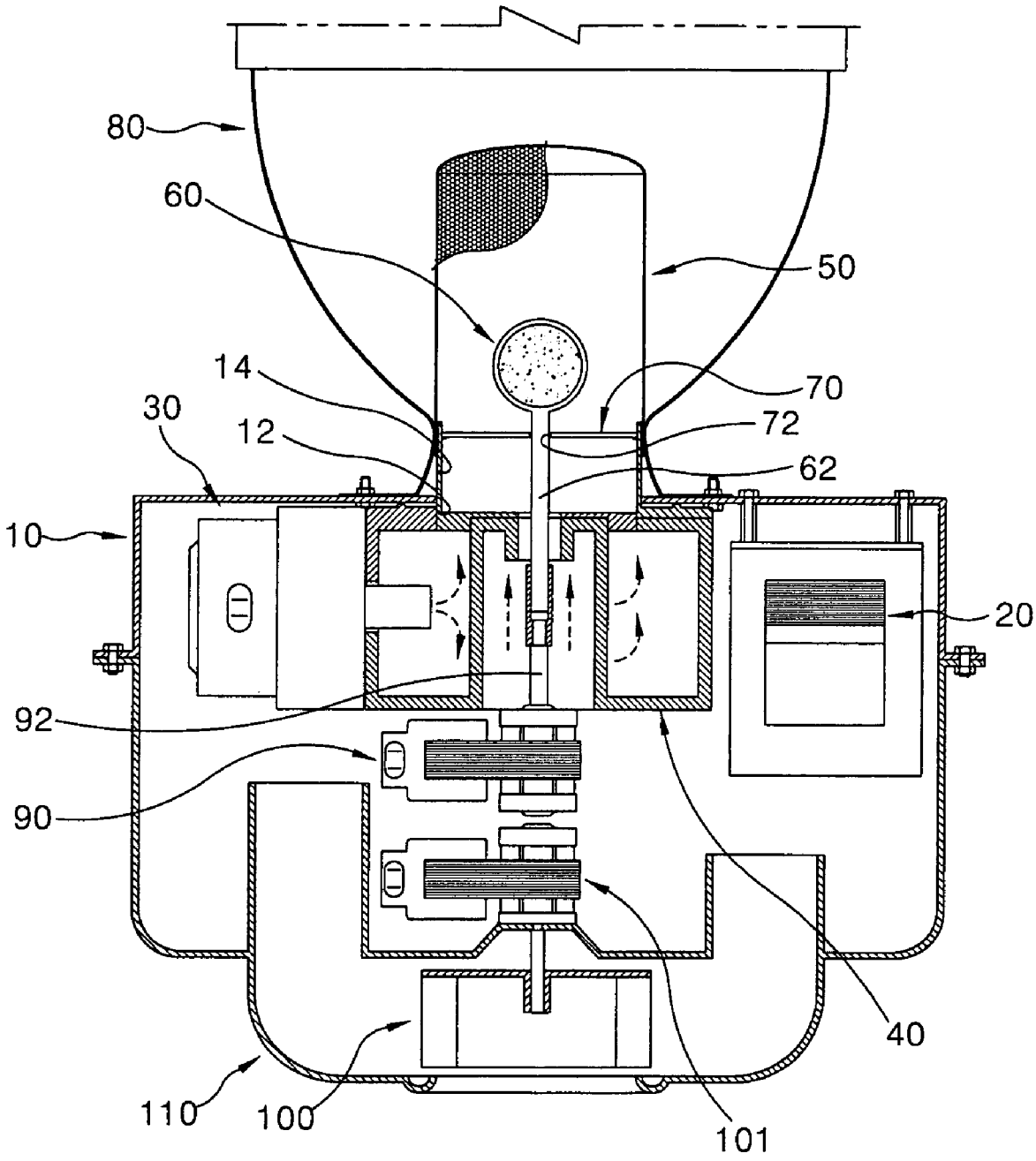
FIG. 1 CONVENTIONAL ART
FIG. 1 is a longitudinal sectional view illustrating a light apparatus using microwave energy according to the conventional art.
Figure 2:
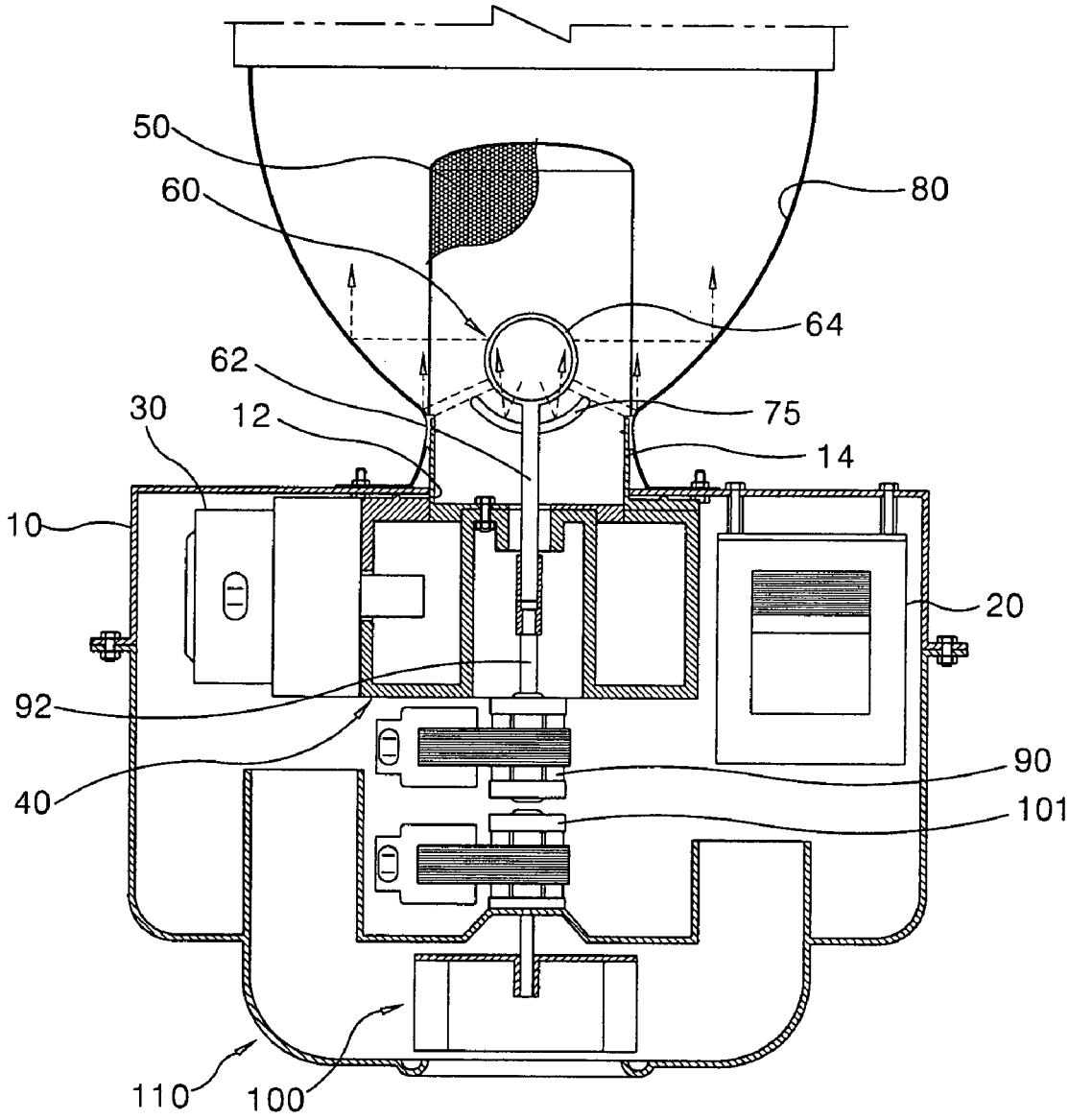
FIG. 2 is a longitudinal sectional view illustrating a light apparatus using microwave energy according to one embodiment of the present invention.

As shown in FIG. 2, a light apparatus using microwave energy according to one embodiment of the present invention comprises a casing 10 having an opening 12 through which microwave passes, and a flange 14 outwardly extended from a circumference of the opening 12; a high voltage generator 20 installed inside the casing 10, for generating and supplying high voltage; a magnetron 30 disposed inside the casing 10, electrically connected with the high voltage generator 20 to generate microwave energy by high voltage; a waveguide 40 fixed to a front of the casing 10, for guiding microwave energy generated from the magnetron 30 toward the opening 12 of the casing 10; a resonator 50 fixed to the flange 14 of the casing 10, communicated with the waveguide 40, and having a resonant region therein where microwave energy is resonated; a bulb 60 rotatably mounted inside the resonator 50, and containing a fill which emits light when excited by microwave energy; a reflector 80 fixed to an outer surface of the casing 10, for forwardly reflecting light emitted from the bulb 60; and a rear mirror 75 integrally coupled to the bulb 60 at a rear side of the bulb 60, for forwardly reflecting light rearwardly emitted from the bulb 60.

In addition, the lighting apparatus further comprises a fan housing 110 installed inside the casing 10, having an airflow path therein through which an external air is sucked, for cooling heat generated from the high voltage generator 20 and the magnetron 30; a cooling fan 100 provided inside the fan housing 110, for sucking external air; a fan motor 101 for rotating the cooling fan 100; and a bulb motor 90 for rotating the bulb 60 so as to cool heat generated from the bulb 60.

The resonator 50 is formed in a cylindrical shape of which one side is closed so as to prevent a leakage of microwave, and also formed in a mesh so that light emitted from the bulb 60 can pass therethrough.

The bulb 60 consists of a bulb portion 65 positioned outside the opening 12, formed in a spherical shape, and having a filling space therein; and a bulb stem 62 extended from one side of the bulb portion 64, and formed in a rod shape with a certain length. The bulb stem 62 penetrates the waveguide 40, and is connected with a rotational shaft 92 of the bulb motor 90. Accordingly, in case that the rotational shaft 92 is rotated by the operation of the bulb motor 90, the bulb 60 is rotated by the rotation of the rotational shaft 92.

The filling space of the bulb 60 is filled with several fills such as metal halide, sulfur (S), selenium (S) or the like for leading light emitting. Also, an inert gas such as argon (Ar), xenon (Xe), krypton (Kr) or the like for forming a plasma at an initial light-emitting and an additional material for easily emitting by helping initial electric discharge and for controlling a spectrum of light are filled in the filling space of the bulb 60.

The rear mirror 75 is integrally fixed to the bulb stem 62 in the vicinity of an outer circumference of the bulb portion 64 of the bulb 60. Preferably, a width of the rear mirror 75 and a distance between the rear mirror 75 and the outer circumference of the bulb are designed so that light emitted from the bulb 60 is not transmitted to a rear side of the rear mirror 75, but is fully reflected. That is, preferably, the rear mirror 75 and the reflector 80 are designed so that the light which is not reflected by the rear mirror 75 is reflected by the reflector 80.

In addition, preferably, the rear mirror 75 is formed in a hemispherical shape having a curved surface which is curved towards the bulb 60. At this time, a curvature of the curved surface of the rear mirror 75 is formed so that the center of the bulb 60 is positioned at a focal point of the curved surface, in order to have effective light-reflection efficiency.

Hereinafter, operations of the light apparatus using microwave energy according to one embodiment of the present invention will now be described.

First, high voltage is generated when an external power is applied to the high voltage generator 20, and microwave energy is generated at the magnetron 30 by the high voltage. And, the microwave energy generated from the magnetron 30 is transmitted to the resonator 50 through the waveguide 40, and excites a fill within the bulb 60 disposed inside the resonator 50. Accordingly, the fill within the bulb 60 emits light when excited by microwave energy, the reflector 80 forwardly reflects light emitted around the bulb 60, and the rear mirror 75 being rotated together with the bulb 60 reflects light emitted to the rear of the bulb 60.

At the same time, the cooling fan 100 is rotated by an operation of the fan motor 101 and thus introduces external air out of the casing 10 into the casing 10, thereby cooling the high voltage generator 20, the magnetron 30 and other internal components. In addition, the bulb 60, the bulb stem 62 and the rear mirror 75 are integrally rotated for being cooled by the operation of the bulb motor 90, to be cooled.

In the apparatus using microwave energy according to one embodiment of the present invention constructed and operated as described above, the rear mirror for forwardly reflecting light emitted to a rear side from the bulb is integrally fixed to the bulb, thus light emitted to a rear side from the bulb is optimally reflected toward a front side of the lighting apparatus, and lighting efficiency of the lighting apparatus can be improved.

In addition, since the rear mirror is formed in a hemispherical shape having a curved surface which is curved toward the bulb, unidirectionality of light can be improved.

Also, since the rear mirror is integrally fixed to the bulb stem in the vicinity of the bulb, a reflective area of the rear mirror can be reduced compared to the conventional art wherein the rear mirror is fixed to the casing at large distance from the bulb.

In addition, since the rear mirror is integrally rotated with the bulb, heat transmitted to the rear mirror is easily cooled, and thermal damage such as peeling away of a coated layer of the rear mirror or the like can be prevented.

Hereinafter, a lighting apparatus using microwave energy according to another embodiment of the present invention will be described with reference to FIG. 3. Hereinafter, the same numerals will be given for the same parts as one embodiment of the present invention, and description thereof will be omitted.

Figure 3:
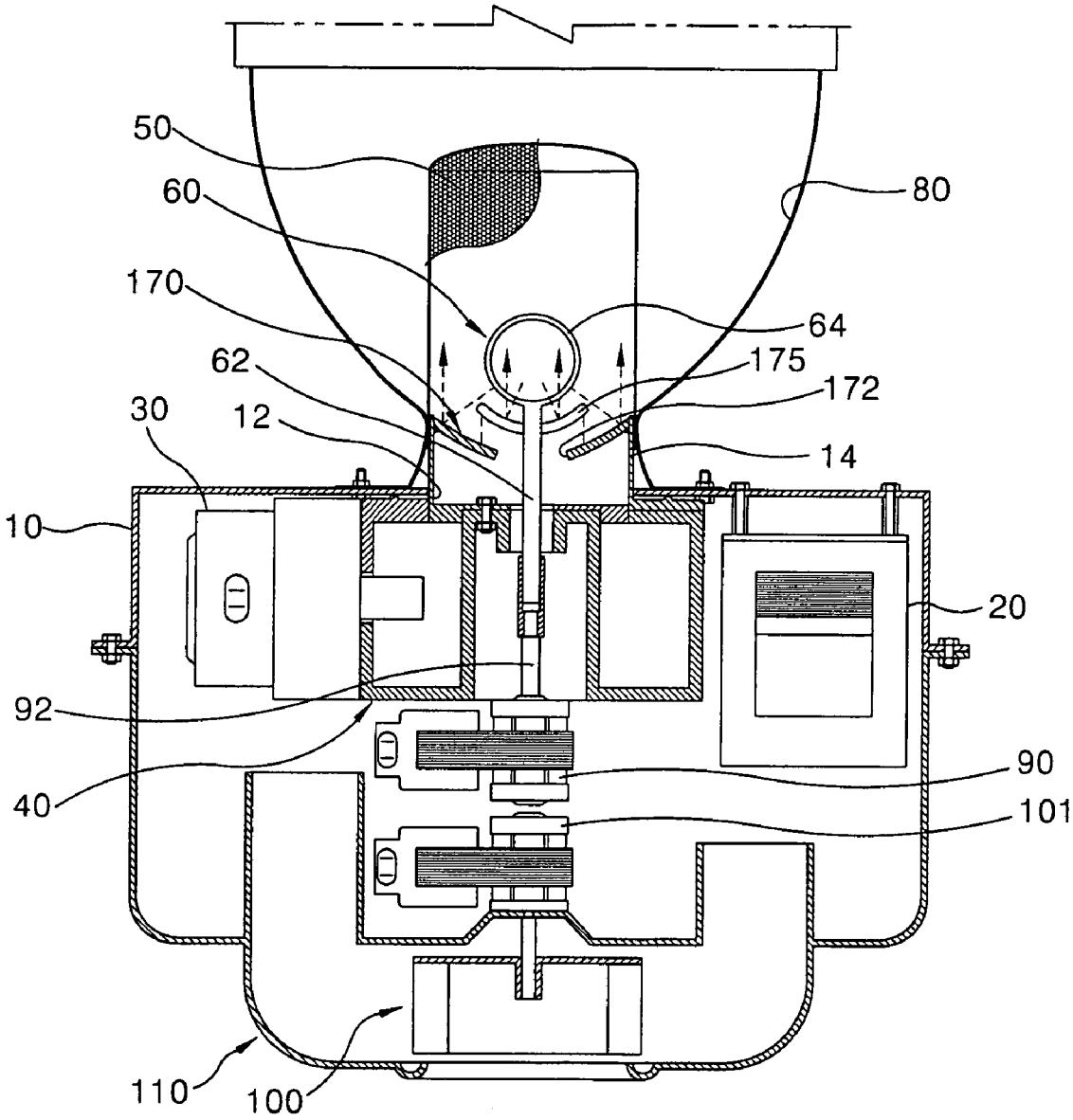
FIG. 3 is a longitudinal sectional view illustrating a light apparatus using microwave energy according to another embodiment of the present invention.

As shown in FIG. 3, a light apparatus using microwave energy according to another embodiment of the present invention includes a rear mirror 175 integrally coupled to a bulb stem 62 of the bulb 60, and integrally rotated with the bulb 60, for forwardly reflecting light which is emitted to a rear from the bulb 60; and a fixed mirror 170 fixed to the inside of a flange 14 outwardly extended from a circumference of an opening 12 of the casing 10, and having a hole 172 in a center of the rear mirror 175 so that the bulb stem 62 is rotatably inserted therein.

Preferably, the rear mirror 175 is disposed in the vicinity of an outer circumferential surface of the bulb 60 so as to improve reflecting efficiency, and is formed in a hemispherical shape having a curved surface which is curved toward the bulb 60. Here, a curvature of the curved surface of the rear mirror 175 is formed so that the center of the bulb 60 is positioned at a focal point of the curved surface of the rear mirror 175.

Preferably, the fixed mirror 170 is formed in a hemispherical shape having a curved surface, which is curved toward the bulb 60 so as to improve light reflection efficiency. In addition, preferably, a curvature of the curved surface of the fixed mirror 170 is formed so that the center of the bulb 60 is positioned at a focal point of the curved surface of the fixed mirror 170.

Preferably, a width of the hole 172 of the fixed mirror 170 is formed to be smaller than a width of the rear mirror 175 so that the light emitted from the bulb 60 is not transmitted to a rear of the fixed mirror 170.

An interval between an inner circumferential surface of the hole 172 of the fixed mirror 170 and an outer circumferential surface of the bulb stem 62 can be widened as much as the width of the rear mirror 175, whereby the heat of the bulb 60, which is transmitted to the bulb stem 62 has a smaller effect on the hole 172 of the fixed mirror 170.

Since the rear mirror 175 is installed adjacent to the bulb 60, the rear mirror 175 is made of a high priced heat resistible material such as quartz. However, since the fixed mirror 170 at a relatively large distance from the bulb 60, and the heat has a small effect on the hole 172 of the fixed mirror 170, the fixed mirror 170 is made of a relatively low priced ceramic material such as $Al_2O_3$, $Si_3N_4$ or AlN material. According to this, material cost of the light apparatus can be reduced. In addition, since the fixed mirror 170 is additionally provided besides the rear mirror 175, a reflective area of the rear mirror 175 can be reduced more, and the material cost can be reduced more.

By the construction as above, the light which is rearwardly emitted from the bulb 60 is forwardly reflected by the rear mirror 175 rotated with the bulb 60 and the fixed mirror 170 fixed to the casing 10.

In the light apparatus using microwave energy according to another embodiment of the present invention constructed and operated as described above, since the rear mirror for forwardly reflecting light emitted toward a rear of the bulb is integrally fixed to the bulb, light rearwardly emitted from the bulb is optimally reflected, thus the lighting efficiency of the lighting apparatus can be improved.

And, since the rear mirror is integrally fixed to the bulb stem in the vicinity of the bulb, a reflective area of the rear mirror is reduced, thus material cost is reduced.

In addition, since the rear mirror is integrally rotated with the bulb, heat transmitted to the rear mirror is easily cooled, thereby preventing thermal damage such as peeling away of a coated layer of the rear mirror.

In addition, since the fixed mirror fixed to the casing at a rear side of the rear mirror is additionally provided, a reflective area of the rear mirror which requires a high priced heat resistible material is reduced more, and thus the material cost is reduced more too.

In addition, since the rear mirror and the fixed mirror are formed in a hemispherical shape having a curved shape which is curved toward the bulb, unidirectionality of light can be improved.

As so far described, a lighting apparatus using microwave energy according to the present invention constructed as above can improve reflection efficiency of light which is emitted to the rear of the bulb, and also reduce material cost of the mirror.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A lighting apparatus using microwave energy, comprising:

a casing;

a reflector fixed to an outer surface of the casing;

a magnetron disposed inside the casing, for generating microwave energy;

a waveguide for guiding microwave energy;

a resonator disposed inside the reflector and providing a resonant region in which the microwave energy is resonated;

a bulb having a stem disposed inside the resonator, and filled with a material which emits light, when excited by the microwave energy;

a rear mirror formed in a hemispherical shape having a curved surface integrally fixed to the bulb stem and integrally rotatable together with the bulb when the bulb is rotated, for forwardly reflecting light rearwardly emitted from the bulb; and a fixed mirror formed in a hemispherical shape having a curved surface fixed to the casing at a rear side of the bulb and having a hole in which a bulb stem rearwardly extended from the bulb is rotatably insertable for forwardly reflecting light emitted to the rear of the bulb, wherein a diameter of the hole of the fixed mirror is formed to be smaller than a width of the rear mirror, and the center of the bulb is positioned at a focal point of both the curved surface of the rear mirror and the curved surface of the fixed mirror.

2. The apparatus of claim 1, wherein the rear mirror is made of a quartz material.

3. The apparatus of claim 1, wherein the fixed mirror is made of a ceramic material.

4. The apparatus of claim 1, wherein the fixed mirror is made of an $Al_2O_3$, $Si_3N_4$ or AlN material.

* * * * *